US009993679B2

(12) United States Patent
Ressler, III

(10) Patent No.: US 9,993,679 B2
(45) Date of Patent: Jun. 12, 2018

(54) EXERCISE DEVICE WITH SPRING LOADED ARM SUPPORT

(71) Applicant: Norman Monroe Ressler, III, Clarksville, TN (US)

(72) Inventor: Norman Monroe Ressler, III, Clarksville, TN (US)

( * ) Notice: Subject to any disclaimer, the term of this patent is extended or adjusted under 35 U.S.C. 154(b) by 0 days. days.

(21) Appl. No.: 15/395,294

(22) Filed: Dec. 30, 2016

(65) Prior Publication Data

US 2017/0189739 A1 Jul. 6, 2017

Related U.S. Application Data

(60) Provisional application No. 62/272,686, filed on Dec. 30, 2015.

(51) Int. Cl.

| | |
|---|---|
| ***A63B 71/00*** | (2006.01) |
| ***A63B 21/00*** | (2006.01) |
| ***A63B 23/12*** | (2006.01) |
| ***A63B 22/20*** | (2006.01) |

(52) U.S. Cl.
CPC ..... *A63B 21/4035* (2015.10); *A63B 21/4021* (2015.10); *A63B 22/20* (2013.01); *A63B 23/1236* (2013.01)

(58) Field of Classification Search
CPC ... A63B 22/20–22/203; A63B 21/4021; A63B 21/4035; A63B 23/1236; A63B 21/015; A63B 21/02; A63B 21/023; A63B 21/025; A63B 21/0407–21/0435; A63B 21/045; A63B 21/0455; A63B 21/4025; A63B 21/4047; A63B 21/4049; A63B 21/4019
USPC ..... 482/131, 132, 141
See application file for complete search history.

(56) References Cited

U.S. PATENT DOCUMENTS

| | | | | |
|---|---|---|---|---|
| 3,809,393 A * | 5/1974 | Jones | A63B 22/20 | 482/132 |
| 4,610,448 A * | 9/1986 | Hill | A63B 23/03533 | 482/141 |
| 5,393,282 A * | 2/1995 | Maclean | A63B 69/0022 | 482/51 |
| 6,186,930 B1 * | 2/2001 | Ignaczak | A63B 23/12 | 482/141 |
| 6,575,883 B1 * | 6/2003 | Hinds | A63B 21/0004 | 482/125 |
| 6,773,379 B1 * | 8/2004 | Bing | A63B 22/20 | 482/132 |

(Continued)

*Primary Examiner* — Gregory Winter
(74) *Attorney, Agent, or Firm* — Global Intellectual Property Agency, LLC; Jordan Sworen

(57) ABSTRACT

An exercise device has a base with a plurality of rollers secured to a bottom surface thereof. A handle with an extended stem is rotatably attached to two columns that extend from a top surface of the base. A brace is attached to the stem and designed to comfortably contain the forearm of a user. The handle is connected to a spring that applies a rotational bias when the stem is rotated away from a starting position. In operation, an individual assumes an initial push up stance and grasps the handles of two such devices, with the brace positioned underneath each forearm. As the user stretches outward, the base rolls along the brace and pushes up against the forearms. This assists a user when retracting to the initial stance.

7 Claims, 5 Drawing Sheets

(56) References Cited

U.S. PATENT DOCUMENTS

| | | | | |
|---|---|---|---|---|
| 7,621,858 | B2 * | 11/2009 | Sheron | A63B 21/0618 482/129 |
| 7,935,039 | B2 * | 5/2011 | Dannenberg | A63B 22/14 482/141 |
| 8,157,713 | B1 * | 4/2012 | Siskowic | A63B 21/0004 482/141 |
| 9,358,419 | B1 * | 6/2016 | Smith | A63B 21/06 |
| 2004/0266593 | A1 * | 12/2004 | Schwendeman | A63B 23/12 482/140 |
| 2005/0101461 | A1 | 5/2005 | Johnson | |
| 2007/0243978 | A1 | 10/2007 | Allen | |
| 2010/0216615 | A1 | 8/2010 | Rios et al. | |
| 2010/0317496 | A1 * | 12/2010 | Abranchess | A63B 21/0004 482/141 |
| 2012/0238420 | A1 * | 9/2012 | Meininger | A63B 21/00076 482/132 |
| 2013/0217549 | A1 * | 8/2013 | Marji | A63B 21/068 482/132 |
| 2014/0141949 | A1 * | 5/2014 | Mills | A63B 23/1236 482/140 |
| 2014/0162857 | A1 * | 6/2014 | Shade | A63B 23/1236 482/141 |
| 2015/0005140 | A1 * | 1/2015 | Adkins | A63B 21/4035 482/92 |
| 2015/0290494 | A1 * | 10/2015 | King | A63B 71/0622 482/8 |
| 2017/0050082 | A1 * | 2/2017 | Whitaker | A63B 21/0618 |
| 2017/0087398 | A1 * | 3/2017 | Chang | A63B 21/0442 |
| 2017/0304669 | A1 * | 10/2017 | LaCaze | A63B 21/023 |

* cited by examiner

EXERCISE DEVICE WITH SPRING LOADED ARM SUPPORT

CROSS REFERENCE TO RELATED APPLICATIONS

This application claims the benefit of U.S. Provisional Application No. 62/272,686 filed on Dec. 30, 2015. The above identified patent application is herein incorporated by reference in its entirety to provide continuity of disclosure.

BACKGROUND OF THE INVENTION

The present invention relates to exercise devices. More specifically, the present invention relates to an exercise devices designed to assist a user when performing certain arm extension exercises.

Regular exercise is universally acknowledged to be an essential part of a healthy lifestyle. Among popular muscle training exercises is the push up exercise, which, when properly executed, can improve the strength and tone of an individual's arms, legs and core body muscles. There are many variations on the classical push up stance designed to target specific muscles groups. For example, positioning the arms at multiple places relative to an individual's body affects different muscles. However, an individual is usually limited to a single chosen position per push up. Accordingly, a device designed to incorporate various muscle groups within a single push up movement is desired.

SUMMARY OF THE INVENTION

In view of the foregoing disadvantages inherent in the known types of exercise devices now present in the known art, the present invention provides an exercise device with a spring loaded arm support wherein the same can be utilized for providing convenience for the user when performing push up style exercises. The present system comprises a base with a bottom surface and a top surface having a plurality of rollers secured to the bottom surface. A handle is rotatably attached to two columns that extend from the top surface, the handle having a stem extend therefrom. A brace is attached to the stem and designed to comfortably contain the forearm of a user. A spring is connected to the handle and configured to apply a rotational bias to the handle and in turn to the brace. In operation, an individual assumes a push up stance and grasps the handles of two the devices, with the brace positioned underneath each forearm. As the user stretches outward, the base rolls along and the brace pushes up against the forearms. This assists a user when retracting to the initial stance.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
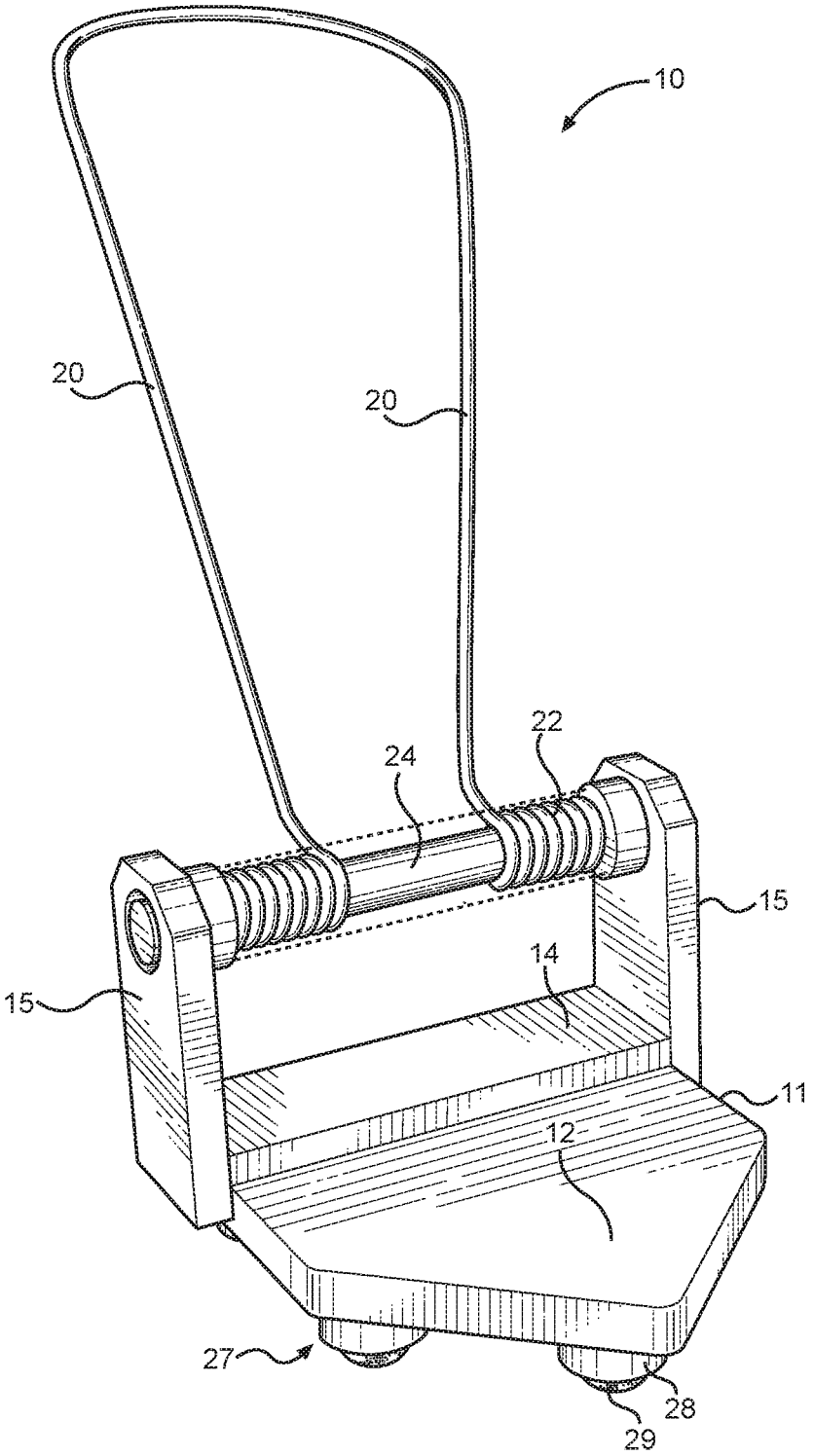
FIG. 1 shows a front perspective view of one embodiment of the exercise device with a spring loaded arm support.

Reference is made herein to the attached drawings. Like reference numerals are used throughout the drawings to depict like or similar elements of the exercise device with a spring loaded arm support. The figures are intended for representative purposes only and should not be considered to be limiting in any respect.

Referring now to FIG. 1, there is shown a rear perspective view of one embodiment of the exercise device with a spring loaded arm support. The exercise device with a spring loaded arm support 10 comprises a base 11 having a plurality of rollers 27 secured to a bottom surface thereof. Two columns 15 extend from a top surface 12 of the base 11 with a central handle 24 extending therebetween. The central handle 24 is rotatably attached to the two columns 15 and configured to rotate around an axis extending between the two columns. In some embodiments of the exercise device with a spring loaded arm support 10, the two columns 15 extend from to a U-shaped frame 14 that is secured to the base 11, while in alternative embodiments the columns 15 are integral with the base 11.

A spring 22 is operably attached to the central handle 24 and configured to rotatably bias the central handle 24 toward a starting position wherein the handle is stationary. When a rotational force is applied to the handle 24, turning it away from the starting position, the spring 22 is configured to oppose that force and bias the handle back to the starting position. The force exerts by the spring 22 can vary according to the stiffness of the spring material. Accordingly, the exercise device with a spring loaded arm support 10 can be made to exert a wide range of forces commensurate with different user's needs. An arm support comprising a stem 20 is attached to the central handle and extends therefrom. In some embodiment, the stem 20 is directly attached to the spring 24, while in other embodiments the stem 20 is attached to the handle 24. In either configuration, when a force is applied to the stem 20, the spring 22 rotates as well.

Figure 2:
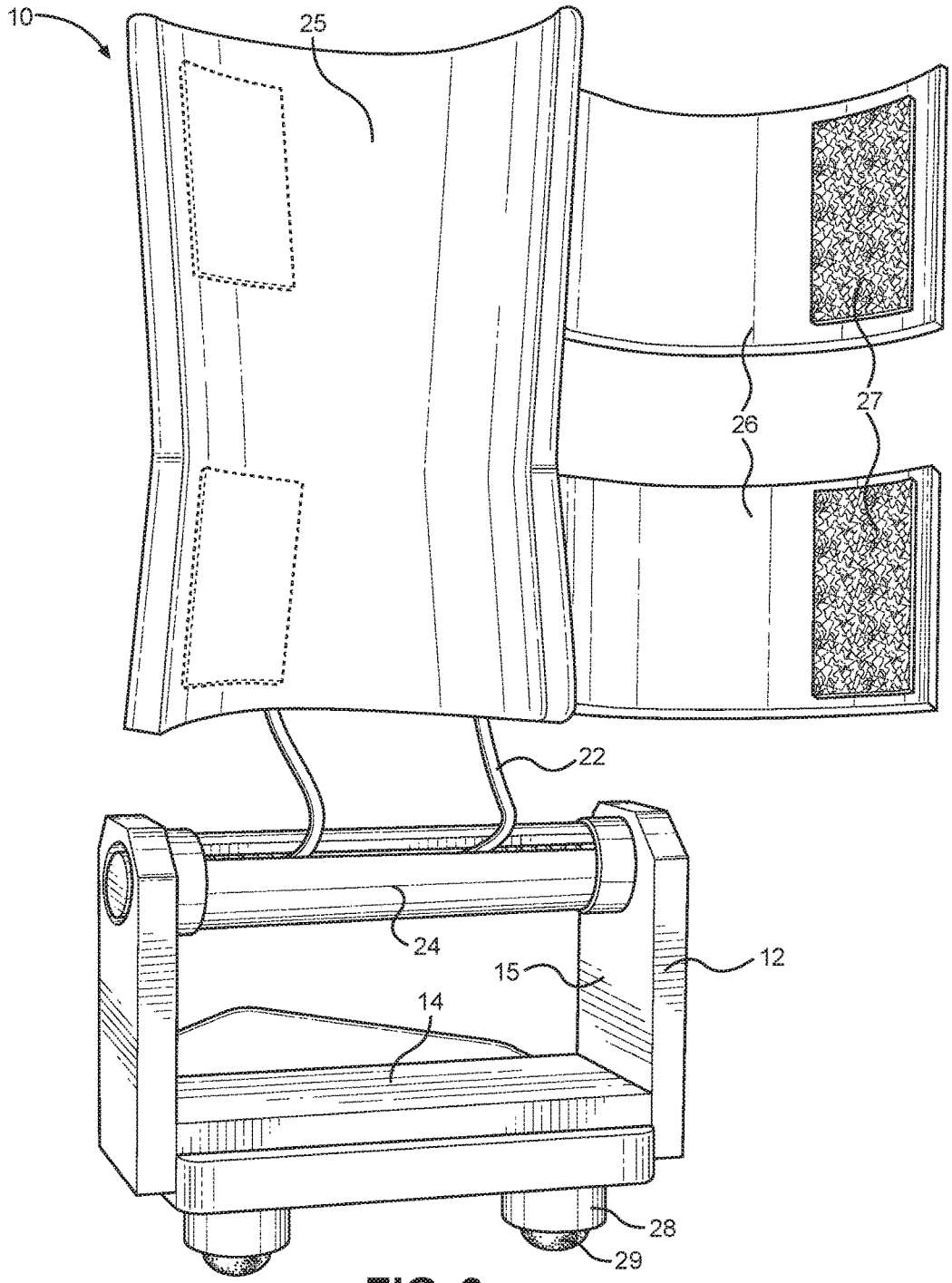
FIG. 2 shows a rear perspective view of one embodiment of the exercise device with a spring loaded arm support.

Referring now to FIG. 2, there is shown a front perspective view of one embodiment of the exercise device with a spring loaded arm support. In some embodiments of the exercise device with a spring loaded arm support 10, the arm support 10 further comprises a brace attached to the stem 20. The brace includes a panel 25 having one or more straps 26 extend from one side thereof, wherein the straps 26 can be removably attached to the panel 25. The straps 26 are adapted to secure to a wrist of a user, and the panel 25 tethers the user to the spring loaded arm support 10 when the user is gripping the handle 24.

In one embodiment, the straps 26 are fixedly attached to the panel 25 on one end and are removably attached to the panel 25 at an opposing end via a fastener 27. For example, the fastener 27 may comprise hook and look material disposed on both strap and the panel. The hook and look material may be placed at various positions on the panel 25. Thus, a user can easily adjust the straps 26 to a desired length by altering where the strap 26 attaches to the panel 25. Additionally, the panel 25 may comprise a molded or padded material adapted to comfortably engage with a user's forearm.

Figure 3:
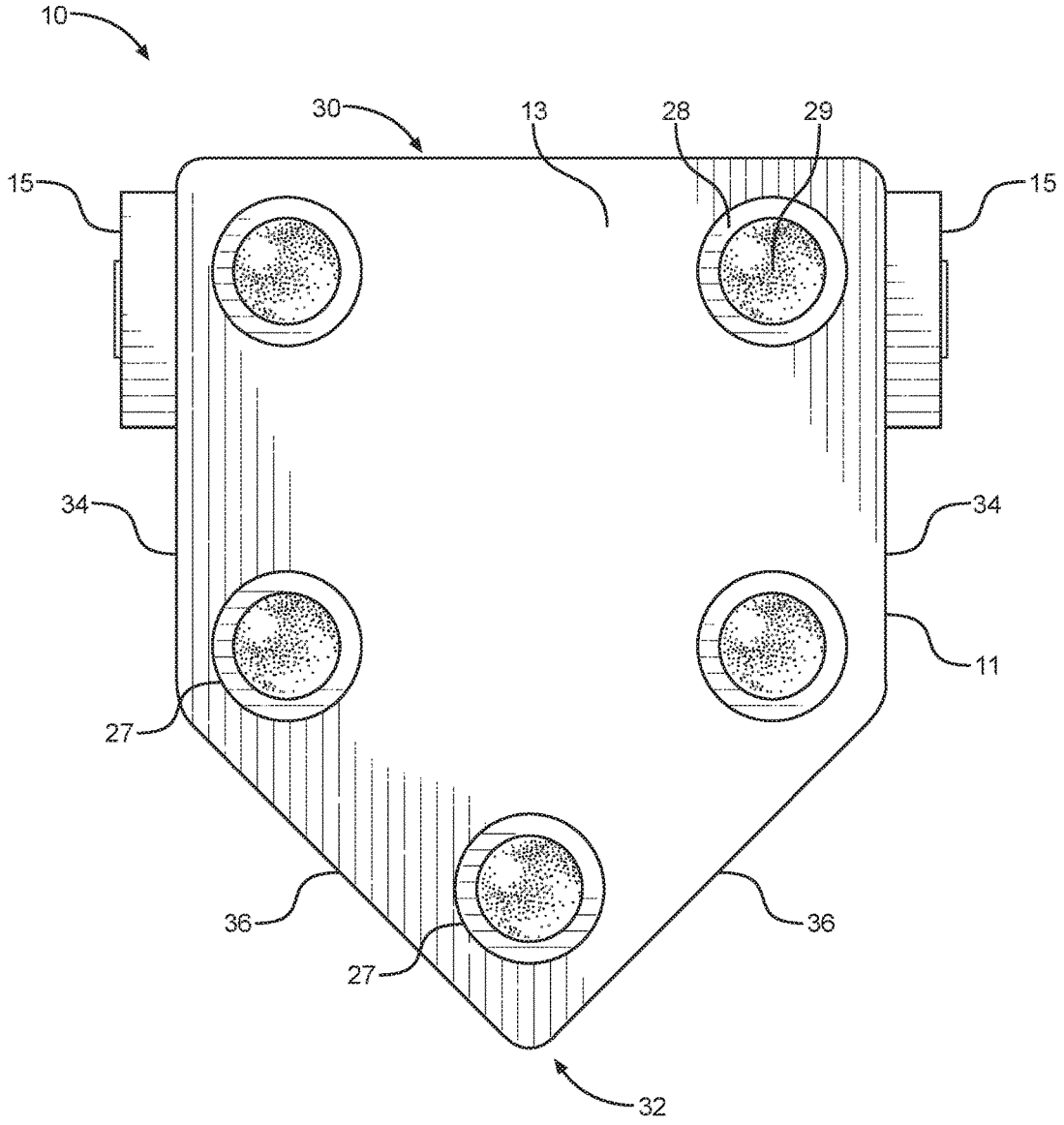
FIG. 3 shows a bottom plan view of the exercise device with a spring loaded arm support.

Referring now to FIG. 3, there is shown a bottom plan view of the exercise device with a spring loaded arm support. The rollers 27 are secured to the bottom surface 13 of the base 11. The rollers 27 are omnidirectional and configured to allow movement along any path without restriction. In some embodiments of the exercise device with a spring loaded arm support 10, the rollers 27 comprise ball transfers that include a casing 28 and a freely rotatable ball 29 inserted therein.

The columns 15 are secured toward a rear edge 30 of the base 11. This ensures that when a force is applies to the handle 24 turning the arm support toward a front edge 32 of base 11, the force is evenly spread amount the rollers 27, preventing the base 11 from turning over. In some embodiments of the exercise device with a spring loaded arm support 10, the base 11 comprises the shape of an irregular pentagon having two parallel edges 34 perpendicular to the rear edge 30 and two front edges 32 opposite the rear edge 30 forming a point. A roller 27 is disposed underneath the point and opposite the rear edge 30, allowing for additional support to counterbalance a force applied to the stem. This arrangement increases the stability of the base when the exercise device 10 is in use.

Figure 4:
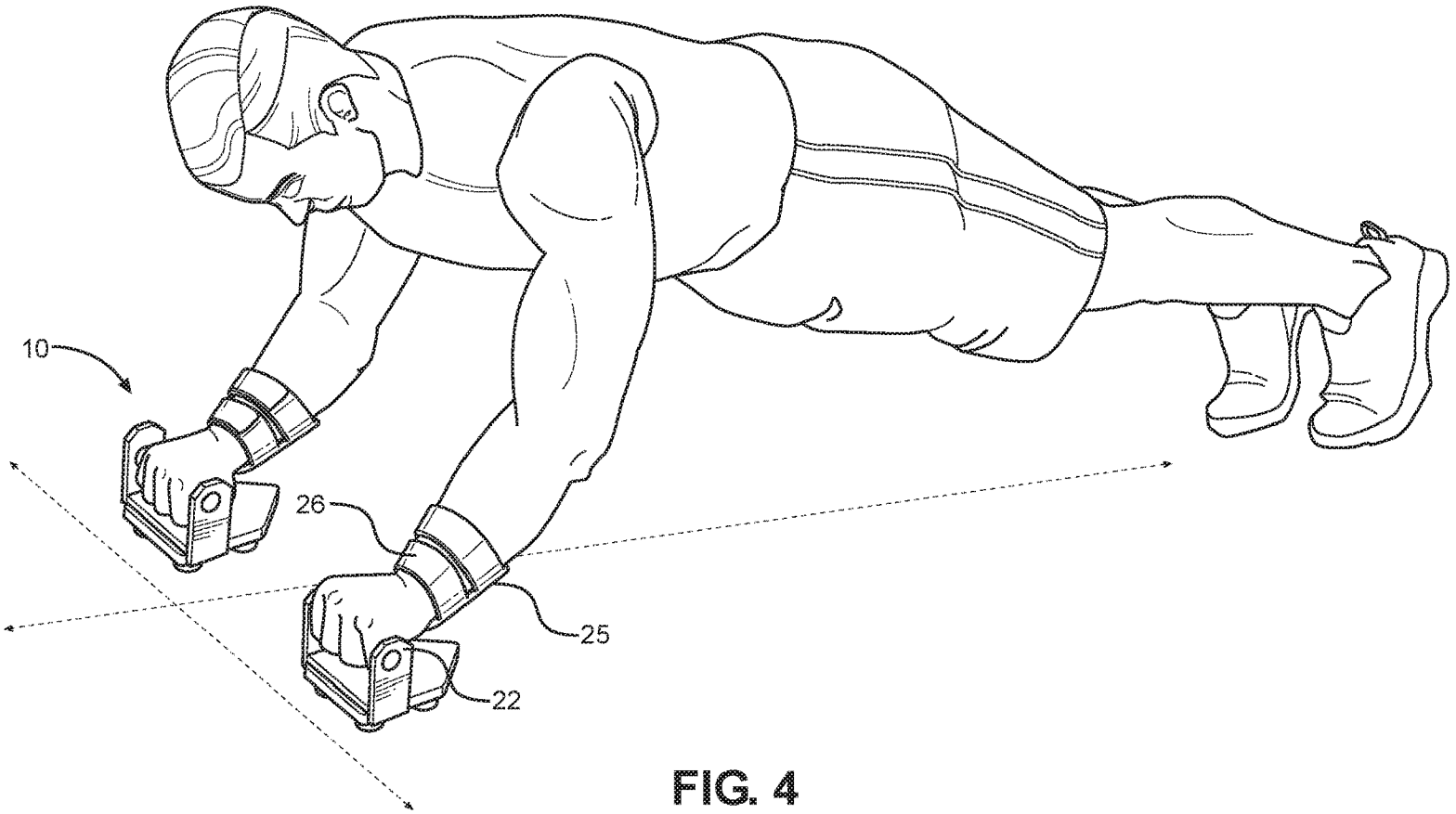
FIG. 4 shows a user with the exercise device with a spring loaded arm support in a starting position.
Figure 5:
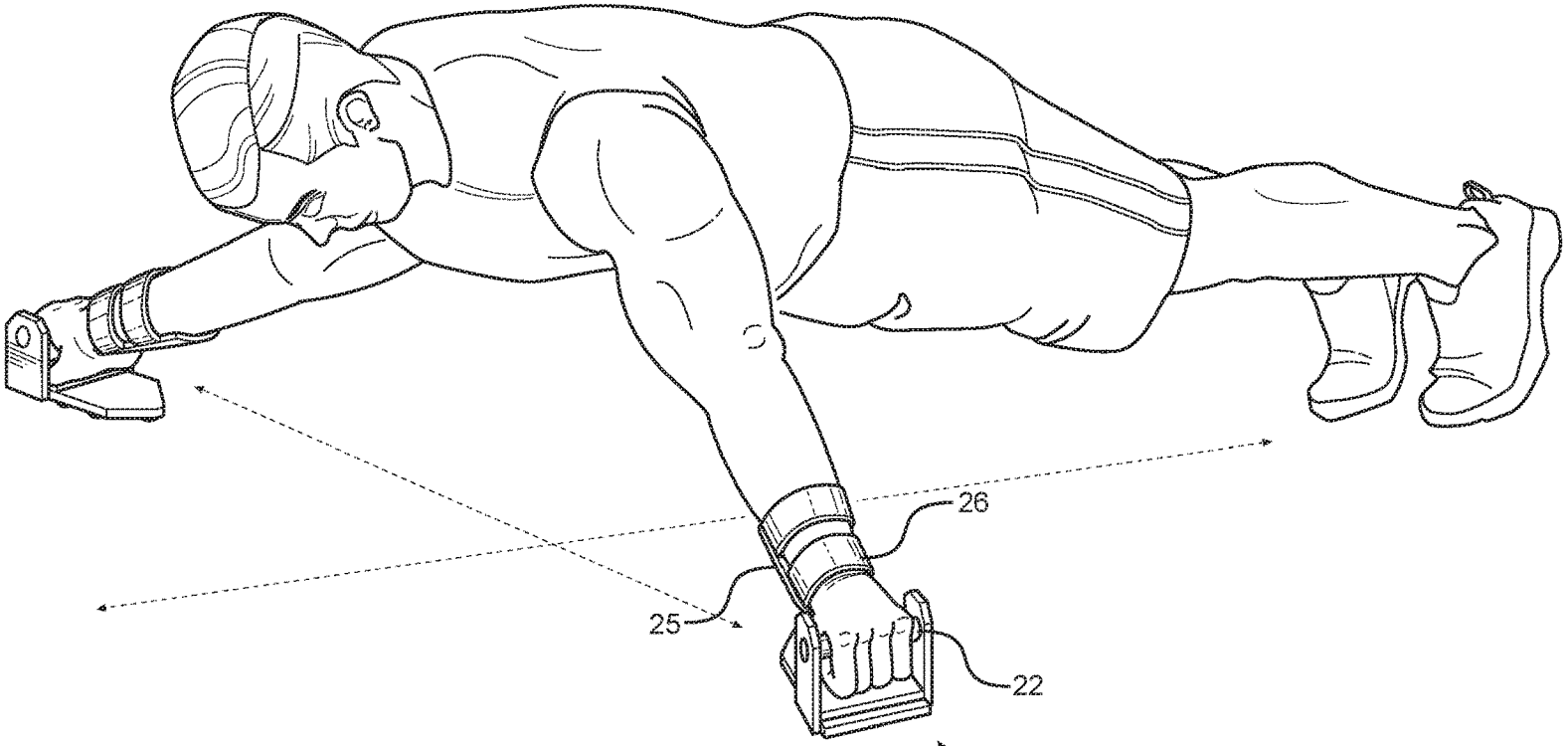
FIG. 5 shows a user with the exercise device with a spring loaded arm support in an extended position.

Referring now to FIGS. 4 and 5, there is shown a user with the exercise device with a spring loaded arm support in a starting position, and a user with the exercise device with a spring loaded arm support in an extended position, respectively. In most cases, two of the exercise devices 10 are used simultaneously. A user grasps the handle 24 with each hand after sliding their forearms through the straps 26 of the brace and form a push up stance in a prone starting position as seen in FIG. 4. The user then extends their arms outward as seen in FIG. 5, lowering their upper body while pushing the exercise device with a spring loaded arm 10 away from them. While in an extending position, the spring applies a rotational force against the stem, which is translated to the panel 25 and subsequently the user's forearms. This force assists a user when retracting their arms back to the starting position.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise device, comprising:

a base including a plurality of rollers disposed on a bottom surface thereof;

two or more columns extending from a top surface of the base, wherein a handle extends between the two or more columns, and wherein the handle is rotatably attached between the two or more columns;

a spring operably attached to the handle, wherein the spring rotatably biases the handle toward a starting position;

a stem attached to the handle and extending therefrom; and a brace attached to the stem, the brace comprising a panel having a strap extending therefrom, wherein the strap is configured to be removably secured to the panel via a fastener.

2. The exercise device of claim 1, wherein the two or more columns are integral to a U-shaped frame disposed on the base.

3. The exercise device of claim 1, wherein the two or more columns are disposed toward a rear edge of the base.

4. The exercise device of claim 3, wherein a shape of the base comprises an irregular pentagon having two parallel edges perpendicular to the rear edge and two front edges opposite the rear edge.

5. The exercise device of claim 1, wherein the fastener comprises hook and loop material.

6. The exercise device of claim 1, wherein the plurality of rollers is omnidirectional.

7. The exercise device of claim 1, wherein the plurality of rollers comprises ball transfers, each ball transfer having a freely rotatable ball inserted within a casing.

* * * * *